US010709994B2

(12) United States Patent
Kwan

(10) Patent No.: US 10,709,994 B2
(45) **Date of Patent: *Jul. 14, 2020**

(54) AUTOMOBILE MODEL

(71) Applicants: GATEWAY AUTOART LIMITED, Hong Kong (CN); GATEWAY AUTOART JAPAN CORPORATION, Fuefuki-shi, Yamanashi (JP)

(72) Inventor: Kelvin Yuetming Kwan, Hong Kong (CN)

(73) Assignees: GATEWAY AUTOART LIMITED, Hong Kong (CN); GATEWAY AUTOART JAPAN CORPORATION, Fuefuki-Shi (JP)

( * ) Notice: Subject to any disclaimer, the term of this patent is extended or adjusted under 35 U.S.C. 154(b) by 82 days.

This patent is subject to a terminal disclaimer.

(21) Appl. No.: 15/124,618

(22) PCT Filed: Mar. 24, 2015

(86) PCT No.: PCT/JP2015/058879
§ 371 (c)(1),
(2) Date: Sep. 8, 2016

(87) PCT Pub. No.: WO2016/059811
PCT Pub. Date: Apr. 21, 2016

(65) Prior Publication Data

US 2017/0014724 A1 Jan. 19, 2017

(30) Foreign Application Priority Data

Oct. 14, 2014 (WO) ..... PCT/JP2014/077768

(51) Int. Cl.
*A63H 17/26* (2006.01)

(52) U.S. Cl.
CPC ..... *A63H 17/262* (2013.01)

(58) Field of Classification Search
CPC ..... A63H 17/262; A63H 17/002; A63H 17/26
(Continued)

(56) References Cited

U.S. PATENT DOCUMENTS 3,082,569 A * 3/1963 Albiani ..... A63H 17/262 446/471
3,643,372 A * 2/1972 Nash ..... A63H 17/12 446/425

(Continued)

FOREIGN PATENT DOCUMENTS

CN 1911481 A 2/2007
CN 202666397 U 1/2013

(Continued)

OTHER PUBLICATIONS

English Translation of PCT/JP2015/058879.*

(Continued)

*Primary Examiner* — Joseph B Baldori
(74) *Attorney, Agent, or Firm* — Ladas & Parry LLP

(57) ABSTRACT

In the present invention, a resin body has fixed thereto a metal reinforcing member that has a frame part to which side sills of the body abut; therefore while the body is molded from resin to facilitate machining of the details, the metal reinforcing member makes the body (in particular, the portions of the side sills located just below doors) less likely to bend. This configuration allows the doors to be opened and closed stably and, through the metal, gives a sense of weight to the automobile model that can be felt when held by the user.

11 Claims, 4 Drawing Sheets

(58) Field of Classification Search
USPC ..... 446/465, 469, 470, 471
See application file for complete search history.

(56) References Cited

U.S. PATENT DOCUMENTS

| | | | | | |
|---|---|---|---|---|---|
| 3,791,662 | A * | 2/1974 | Glass | A63H 17/002 | 280/827 |
| 3,811,218 | A * | 5/1974 | Salmon | A63H 17/002 | 446/94 |
| 3,942,285 | A * | 3/1976 | Dehner | A63H 17/05 | 446/470 |
| 4,188,748 | A * | 2/1980 | Rich | A63H 17/44 | 446/430 |
| 4,411,098 | A * | 10/1983 | Birdsall | A63H 17/26 | 446/457 |
| 4,466,215 | A | 8/1984 | Hanazato | | |
| 4,488,375 | A * | 12/1984 | Cheng | A63H 17/40 | 446/437 |
| 4,533,336 | A * | 8/1985 | Dixon | A63H 17/26 | 312/219 |
| 4,588,386 | A * | 5/1986 | Kennedy | A63H 17/02 | 446/484 |
| 4,986,789 | A * | 1/1991 | Hang | A63H 17/004 | 434/259 |
| 5,062,819 | A * | 11/1991 | Mallory | A63H 17/26 | 446/462 |
| 5,083,969 | A * | 1/1992 | Wagener | A63H 17/26 | 446/470 |
| 5,092,806 | A * | 3/1992 | Brown | A63H 17/28 | 40/538 |
| 5,120,254 | A * | 6/1992 | Daniels | A63H 17/262 | 446/466 |
| 5,352,147 | A * | 10/1994 | Nagel | A63H 17/28 | 446/409 |
| 5,688,021 | A * | 11/1997 | Tomforde | B62D 23/005 | 296/191 |
| 5,816,888 | A * | 10/1998 | Myers | A63H 17/395 | 446/456 |
| 5,919,077 | A | 7/1999 | Gondcaille | | |
| 6,419,547 | B1 * | 7/2002 | Hartelius | A63H 17/262 | 446/468 |
| 6,582,275 | B1 * | 6/2003 | Lai | A63H 17/262 | 446/456 |
| 6,918,627 | B2 * | 7/2005 | Mataja | B62K 9/00 | 296/177 |
| 7,568,962 | B2 * | 8/2009 | Amadio | A63H 17/002 | 446/470 |
| 2004/0198143 | A1 * | 10/2004 | Grzesek | A63H 17/002 | 446/129 |
| 2005/0202750 | A1 * | 9/2005 | Tusacciu | A63H 11/10 | 446/454 |
| 2005/0250415 | A1 | 11/2005 | Barthold | | |
| 2007/0037480 | A1 * | 2/2007 | Jarck | A63H 17/002 | 446/470 |
| 2007/0202773 | A1 * | 8/2007 | Yuen | A63H 17/002 | 446/94 |
| 2012/0276809 | A1 | 11/2012 | Verbera et al. | | |
| 2014/0065927 | A1 * | 3/2014 | Su | A63H 17/262 | 446/470 |

FOREIGN PATENT DOCUMENTS

| | | | |
|---|---|---|---|
| DE | 39 03 411 | A1 | 9/1990 |
| JP | S58-182785 | U | 12/1983 |
| JP | S62-78990 | U | 5/1987 |
| JP | 3000273 | U | 8/1994 |
| JP | 11300247 | U | 8/1994 |
| JP | 3005798 | U | 1/1995 |
| JP | 3022216 | U | 3/1996 |

OTHER PUBLICATIONS

Non-English Chinese Office Action dated May 3, 2017 for Chinse Application No. 201580002995.8 with English translation.

Non-English Japanese Office Action and International Preliminary Report on Patentability dated Jul. 4, 2017 for Japanese Application No. 2016-553978.

Supplementary Partial European Search Report dated Dec. 12, 2017 for EP Application No. 15 85 1207.

Espacenet English abstract of DE 39 03 411 Al.

Espacenet English abstract of CN 202666397 U.

Toy Journal, Dec. 2002, Tokyo Toy & Doll Cooperative Association, Dec. 1, 2002, No. 1106, pp. 1-6.

Non-English Chinese Office Action dated Feb. 2, 2018 for Chinese Application No. 201580002995.8 with English translation.

* cited by examiner

AUTOMOBILE MODEL

RELATED APPLICATION

This application is a national phase entry under 35 USC 371 of International Patent Application No.: PCT/JP2015/058879 filed on 24 Mar. 2015, which claims priority from PCT/JP2014/077768 filed on Oct. 14, 2014, the disclosures of which are incorporated in their entirety by reference herein.

TECHNICAL FIELD

The present invention relates to a car type model.

BACKGROUND ART

Conventionally, a car type model (a minicar) is broadly popular as a toy for children or as ornaments which can be endured to see by adults. The ornamental minicar is a commercial product for a user who wants to take a look and enjoy beauty of the minicar and wants to keep at least a shape of a desirable car at a hand. For this reason, it is demanded to finely fabricate the minicar in order to intimate an authentic car as greatly as possible. Therefore, there are offered minicars for ornamental purpose which really reproduce authentic cars from exterior decors to interior decors.

Referring to the ornamental minicar of this kind, moreover, a user enjoys beauty given when placing and seeing the minicar, and furthermore, actually picks up the minicar by a hand to experience a massive feeling and enjoys the minicar by opening a door or the like. For this reason, the ornamental minicar is often manufactured by die casting using a metal such as an alloy or brass in order to exhibit the massive feeling or opening/closing stability.

The die casting is a method of causing a molten alloy to flow into a precision mold made of a metal by applying pressure, thereby performing casting. Since a cast metal thus manufactured has high dimension accuracy, the die casting is suitable for mass production of products under the same standard. However, a shape in every fine part of the ornamental minicar cannot be molded by the die casting and the fine part is to be processed after pull-out of the mold. Conventionally, it is necessary to carry out the processing manually by a skilled worker. For this reason, there is a problem in that the ornamental minicar cannot be mass-produced and a manufacturing cost is increased.

On the other hand, referring to a minicar formed of a resin which is often used as a material of a model, it is possible to process a fine part much more easily than a minicar formed of a metal. Consequently, it is also possible to reduce a manufacturing cost. However, the minicar formed of a resin has no massive feeling when it is held in a hand, and gives a tawdry impression. Moreover, the resin is apt to be flexed by slight force so that opening/closing stability related to an opening/closing portion such as a door or a hood is also damaged by the flexure. In some cases, furthermore, the opening/closing portion is not closed properly due to aging degradation of the resin.

Referring to a running toy having an outside of a body configured from a soft material, it is devised to provide an intermediate plate in a fixation state between the body and each wheel in order to smoothly enable running (for example, see Patent Document 1).

Patent Document 1: Japanese Utility Model No. 3000273

DISCLOSURE OF THE INVENTION

According to the technique described in the Patent Document 1, the intermediate plate reinforces the strength of the body around the wheel to avoid friction of the wheel and the body. Consequently, it is possible to smoothly carry out the running. However, it is impossible to prevent the flexure of the whole body. For this reason, it is impossible to solve a problem in that the opening/closing stability related to the opening/closing portion is damaged. Moreover, it is also impossible to solve the problem in that there is no massive feeling when holding the body in a hand, resulting in a tawdry impression.

In order to solve the problems, it is an object of the present invention to enable exhibition of a massive feeling when a user holds a car type model in a hand and opening/closing stability related to an opening/closing portion even though the body is molded by a resin so as to enable a fine part to be easily processed.

In order to attain the object, a car type model according to the present invention fixes a reinforcing member formed of a metal to a body formed of a resin. The reinforcing member has a frame portion on which a side sill of a body is to abut.

According to the present invention having the structure described above, it is possible to flex a body with difficulty by a reinforcing member formed of a metal even though the body is molded by a resin so as to easily enable the processing of the fine part. Therefore, it is possible to exhibit the opening/closing stability related to the opening/closing portion. In particular, the reinforcing member formed of a metal abuts on the side sill to be a part positioned under a door of the body. Therefore, the side sill portion is flexed with difficulty when the door is to be opened/closed. Consequently, it is possible to exhibit opening/closing stability related to the door. Moreover, since the reinforcing member is constituted by a metal, it is also possible to exhibit a massive feeling when a user holds the car type model in a hand.

BEST MODE FOR CARRYING OUT THE INVENTION

Figure 1:
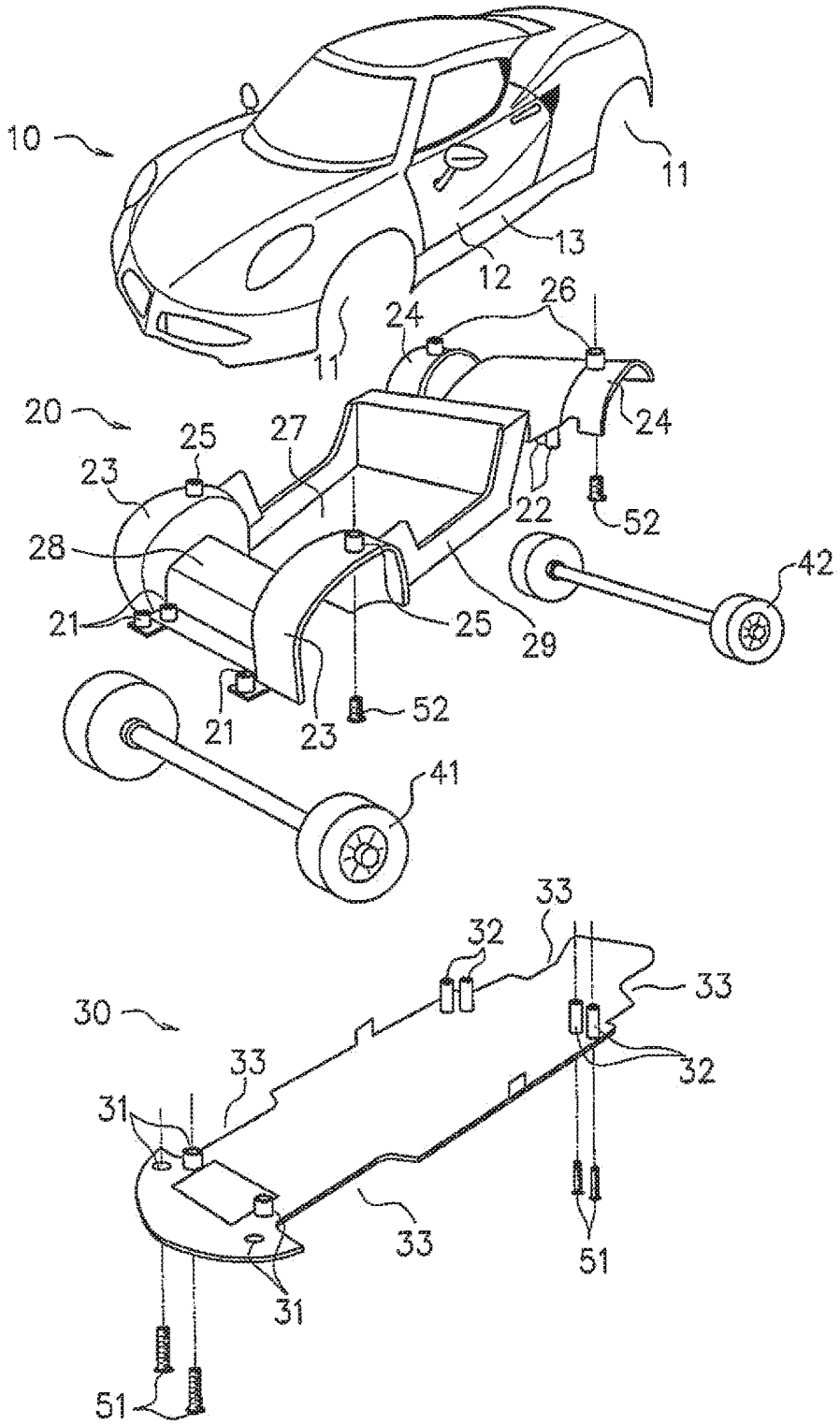
FIG. 1 is an exploded view showing an example of a structure of a car type model (a minicar) according to the present embodiment.
Figure 2:
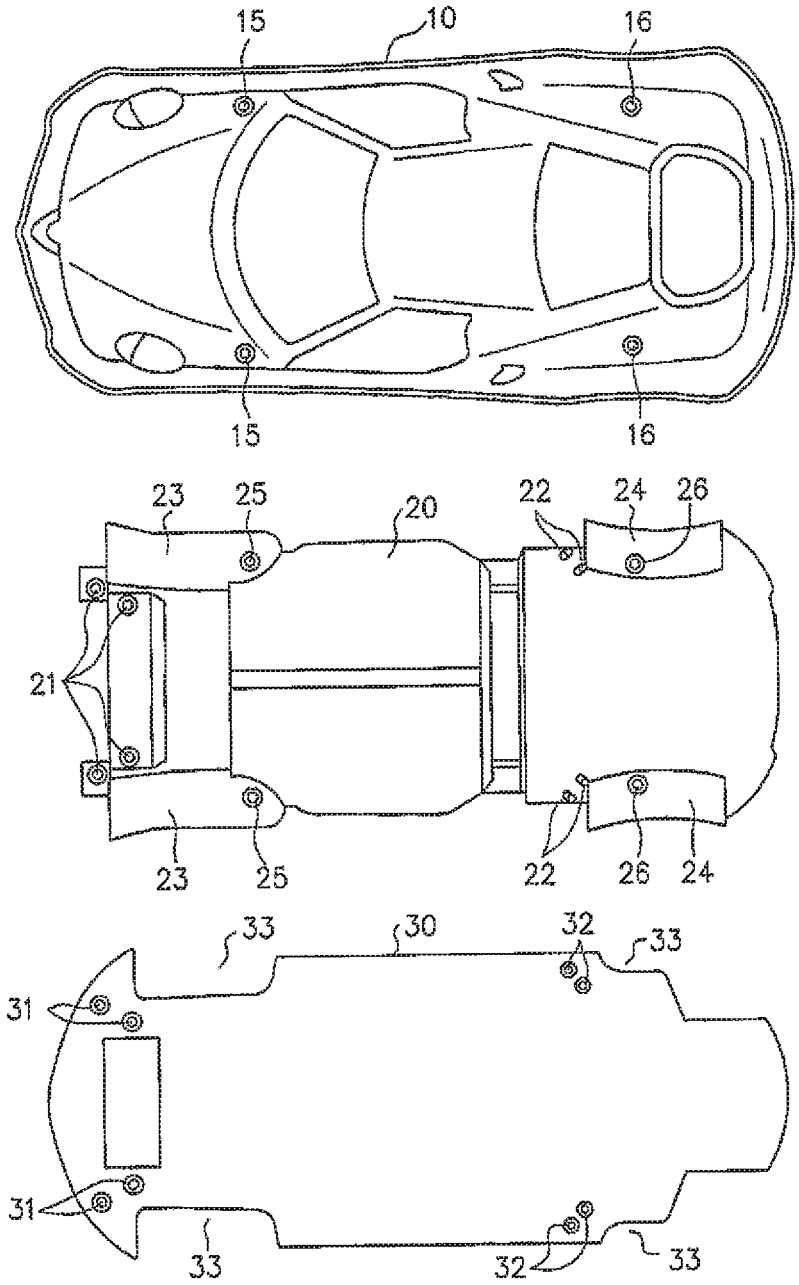
FIG. 2 is a view showing a state in which a body, a reinforcing member and a chassis in the minicar are seen from a back face according to the present embodiment.

An embodiment according to the present invention will be described below with reference to the drawings. FIG. 1 is an exploded view showing an example of a structure of a car type model (a minicar) according to the present embodiment. Moreover, FIG. 2 is a view showing a state in which a body 10, a reinforcing member 20 and a chassis 30 in a minicar are seen from a back face according to the present embodiment.

As shown in FIG. 1, the minicar according to the present embodiment includes the body 10 formed of a resin, the reinforcing member 20 formed of a metal, and the chassis 30 formed of a resin and is configured to assemble them with a plurality of fixing screws 51 and 52 (an example of a fixing member). Herein, the chassis 30 is fixed to the reinforcing member 20 with the fixing screw 51, and the reinforcing member 20 is fixed to the body 10 with the fixing screw 52.

In other words, a plurality of screw fastening holes 31 and 32 is provided on the chassis 30. In the present embodiment, four screw fastening holes 31 are provided on both of left and right sides at a front side of the chassis 30 and four screw fastening holes 32 are provided on both of left and right sides at a rear side thereof. All of these screw fastening holes 31 and 32 are through holes.

The chassis 30 has a notch portion 33 on both of the left and right sides at the front side and both of the left and right sides at the rear side. The notch portion 33 is cut inward in a width direction, and four tires are positioned herein.

Moreover, the reinforcing member 20 has a plurality of screw fastening holes 21 and 22 corresponding to the screw fastening holes 31 and 32 provided in the chassis 30, respectively. In other words, four screw fastening holes 21 are provided on both of left and right sides at a front side of the reinforcing member 20 and four screw fastening holes 22 are provided on both of left and right sides at a rear side thereof. Although the screw fastening holes 21 on the front side are through holes, the screw fastening hole 22 at the rear side is a stop hole. Consequently, the chassis 30 is fixed to the reinforcing member 20 with the fixing screws 51.

Referring to a length in a longitudinal direction, the reinforcing member 20 is configured to have such a size as to include a range from a region on a front side in which a front tire 41 is present to a region on a rear side in which a rear tire 42 is present. Referring to a width in a transverse direction, moreover, the reinforcing member 20 is configured to have such a size as to include a range from a region in which a tire on a left side is present to a region in which a tire on a right side is present. By taking the shape, the reinforcing member 20 closes an almost whole region of a lower surface opening part of the body 10 when it is attached to the body 10.

Moreover, the reinforcing member 20 has a frame portion 29 on which a side sill 13 of the body 10 is to abut. The side sill 13 has a meaning of a sill of a side surface and is a member provided directly under left and right doors 12. By configuring to take such a shape as to have the frame portion 29, thus, when the reinforcing member 20 is attached to the body 10, the left and right frame portions 29 of the reinforcing member 20 abut on the left and right side sills 13 of the body 10. The frame portion 29 has a structure of a sill erected in a certain height such that an abutting area is increased.

Furthermore, the reinforcing member 20 is configured to take such a shape as to have a plurality of (four in a four-wheeled vehicle) wheel houses 23 and 24 for storing a front tire 41 and a rear tire 42 respectively. The four wheel houses 23 and 24 of the reinforcing member 20 are fitted in cut portions 11 formed on the body 10 along curves of the wheel houses 23 and 24 and thus come in contact with the body 10.

In the present embodiment, the four wheel houses 23 and 24 have screw fastening holes 25 and 26 on respective top parts (in the vicinity of vertexes of curves). In this example, a screw fastening hole 25 is provided on each of the left and right wheel houses 23 for the front tire 41, and a screw fastening hole 26 is provided on each of the left and right wheel houses 24 for the rear tire 42. All of these screw fastening holes 25 and 26 take cylindrical shapes having small heights and are through holes.

Moreover, the body 10 has a plurality of screw fastening holes 15 and 16 corresponding to the screw fastening holes 25 and 26 provided in the reinforcing member 20, respectively. In other words, the screw fastening hole 15 is provided in a position where each of the left and right wheel houses 23 for the front tire 41 are stored, and the screw fastening hole 16 is provided in a position where each of the left and right wheel houses 24 for the rear tire 42 is stored. All of these screw fastening holes 15 and 16 are stop holes.

Consequently, the reinforcing member 20 has the wheel houses 23 and 24 fitted in the cut portion 11 of the body 10 and is fixed to the body 10 with the fixing screw 52 in the positions of the wheel houses 23 and 24.

In the present embodiment, the body 10 and the chassis 30 which are exterior parts of a car are formed of a resin. A fine part of the resin can be processed much more easily than a metal. For this reason, original models of the body 10 and the chassis 30 are mass-produced by a mold, and subsequently, the fine part can easily be processed really to imitate an authentic car by a manual work.

In the present embodiment, moreover, the reinforcing member 20 has such a structure as to include a seat housing portion 27 for accommodating a seat (not shown) and a dashboard installing portion 28 for installing a dashboard (not shown). By attaching a seat and a dashboard which are formed of a resin to the seat housing portion 27 and the dashboard installing portion 28, for example, it is also possible to really reproduce interior decors of the car in order to intimate an authentic car.

Figure 3:
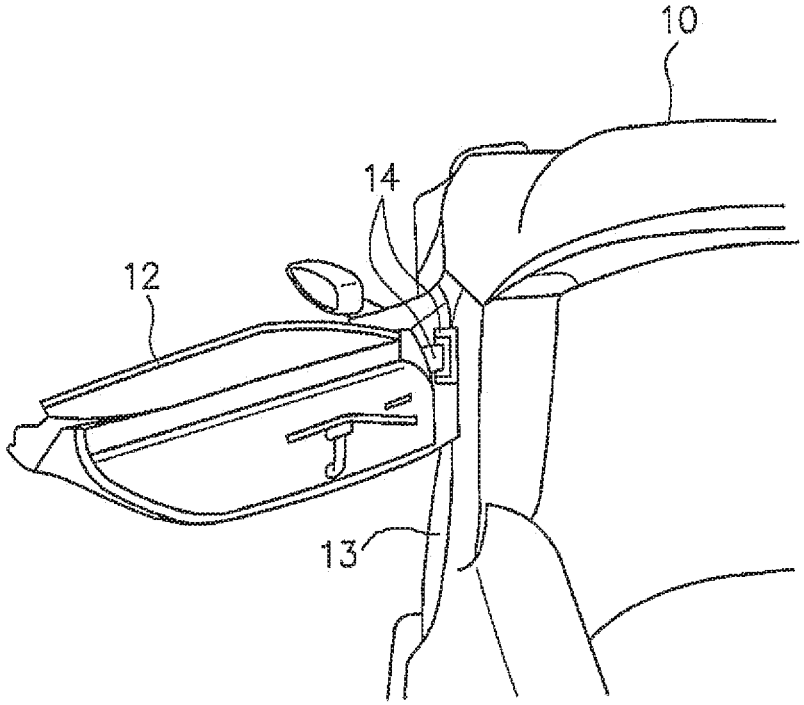
FIG. 3 is a view showing an example of a structure for openably attaching a door to a body according to the present embodiment.

In the present embodiment, furthermore, left and right doors 12 are openably attached to the body 10. FIG. 3 is a view showing an example of a structure for openably attaching the door 12 to the body 10. As shown in FIG. 3, in the present embodiment, the door 12 is openably attached to the body 10 with a pair of hinges 14 provided on the body 10 side and the door 12 side.

As described above, the side sill 13 positioned directly under the door 12 abuts on the frame portion 29 of the reinforcing member 20 provided on an inside of the body 10. Therefore, it is possible to prevent the body 10 (particularly, the side sill 13 portion) from being flexed inward by force generated when the door 12 is closed. Consequently, the side sill 13 portion is flexed with difficulty in the opening/closing operations of the door 12. Thus, it is possible to exhibit opening/closing stability related to the door 12.

As described above, in the present embodiment, the reinforcing member 20 formed of a metal is fixed to the body 10 formed of a resin. Therefore, it is possible to cause the body 10 to be flexed with difficulty by the reinforcing member 20 formed of a metal even through the body 10 is molded by a resin in order to easily enable processing of a fine part.

In the present embodiment, particularly, the reinforcing member 20 is configured to take such a shape as to include the four wheel houses 23 and 24, and the wheel houses 23 and 24 are fitted in the cut portions 11 of the body 10. Furthermore, the reinforcing member 20 is fixed to the body 10 with the fixing screws 52 in the positions of the wheel houses 23 and 24. Consequently, it is possible to employ a structure in which the body 10 formed of a resin is flexed with extreme difficulty.

In the present embodiment, moreover, the frame portion 29 is provided in the reinforcing member 20 so as to abut on the side sill 13 of the body 10. Consequently, it is possible to ensure necessary rigidity and strength for the side sill 13 portion. Therefore, the side sill 13 portion is flexed with difficulty in the opening/closing operations of the door 12. Thus, it is possible to exhibit the opening/closing stability related to the door 12.

In the case in which an opening/closing portion such as the door 12 is attached with the hinges 14 to the body 10 that is formed of a resin and is apt to be flexed without any reinforcement as shown in FIG. 3, consequently, it is possible to exhibit opening/closing stability by avoiding a state in which the door 12 is not closed properly due to the flexure of the body 10. Moreover, the reinforcing member 20 is made of a metal and is formed to be comparatively large in order to close an almost whole region of the lower surface opening part of the body 10. For this reason, it is also possible to exhibit a massive feeling when a user holds the car type model in a hand.

Although the description has been given to the example in which the reinforcing member 20 includes the four wheel houses 23 and 24 on front, rear, left and right parts and is fixed to the body 10 with the fixing screw 52 in the wheel house 23 and 24 portions in the embodiment, the present invention is not restricted thereto. For example, the reinforcing member 20 may be fixed to the body 10 with screwing in portions other than the wheel houses 23 and 24. In this case, the reinforcing member 20 is not necessarily configured to take such a shape as to have the wheel houses 23 and 24.

For example, the reinforcing member 20 can also be configured by a flat plate formed of a metal. However, the reinforcing member 20 is preferably configured to take such a shape as to have the wheel houses 23 and 24 and thus fixed to the body 10 in the wheel house 23 and 24 portions in that it is possible to have a structure in which the body 10 and the reinforcing member 20 come in contact with each other in a larger area and the body 10 is flexed with more difficulty.

As another example, it is also possible to have a structure in which the reinforcing member 20 includes only the wheel house 23 for the front tire 41 or a structure in which the reinforcing member 20 includes only the wheel house 24 for the rear tire 42. In this case, it is possible to fix the reinforcing member 20 to the body 10 with the fixing screw 52 in the wheel house 23 and 24 portions.

In order to exhibit the stability in the opening/closing operations of the door 12, furthermore, it is sufficient that at least the side sill 13 portion is flexed with difficulty. Accordingly, it is sufficient that the reinforcing member 20 has such a structure as to have at least the frame portion 29 which is to abut on the side sill 13.

In addition to the reinforcing member 20 or the reinforcing member (corresponding to a first reinforcing member) according to the variant, moreover, it is also possible to further include a second reinforcing member configured to take a shape along an internal surface of a roof of the body 10. Consequently, the lower surface side of the body 10 (the chassis 30 side) can be mainly reinforced by the first reinforcing member and the upper surface side of the body 10 can be mainly reinforced by the second reinforcing member so that the body 10 can be flexed with more difficulty.

Although the description has been given to the structure in which the left and right doors 12 can be opened/closed in the embodiment, furthermore, a back door of a hatchback, a bonnet or the like as well as the left and right doors 12 may be attached to the body 10 openably. In this case, the reinforcing member 20 is configured to have such a size as to include an almost whole region of a vehicle length (a length in a longitudinal direction) in the embodiment. Therefore, the body 10 is flexed with difficulty in the opening/closing operations of the back door of the hatchback or the bonnet. Thus, it is possible to exhibit the opening/closing stability.

Although the description has been given to the example in which the chassis 30 is formed of a resin in the embodiment, moreover, the present invention is not restricted thereto. For example, the chassis 30 may be formed of a metal to exhibit a massive feeling more greatly. As an ornamental minicar, a fine part at the back side of the chassis 30 is also processed to intimate an authentic car in some cases. In consideration of easiness of the processing, therefore, it is preferable that the chassis 30 should be formed of a resin. Depending on a type of a car, however, the back side of the chassis of the authentic car does not have a very complicated structure and the chassis 30 can be manufactured by simple processing in some cases. In the case of this type of a car, the chassis 30 can be formed of a metal.

Although the description has been given to the example in which the reinforcing member 20 is configured to have such a size as to include the almost whole region of the vehicle length (the length in the longitudinal direction) and that of the vehicle width (the length in the transverse direction) in the embodiment, moreover, the present invention is not restricted thereto. For example, as shown in FIG. 4, a reinforcing member 20' may be configured to have such a size as to include at least the almost whole region of the vehicle width and the frame portion 29 may be provided in the reinforcing member 20'.

Figure 4:
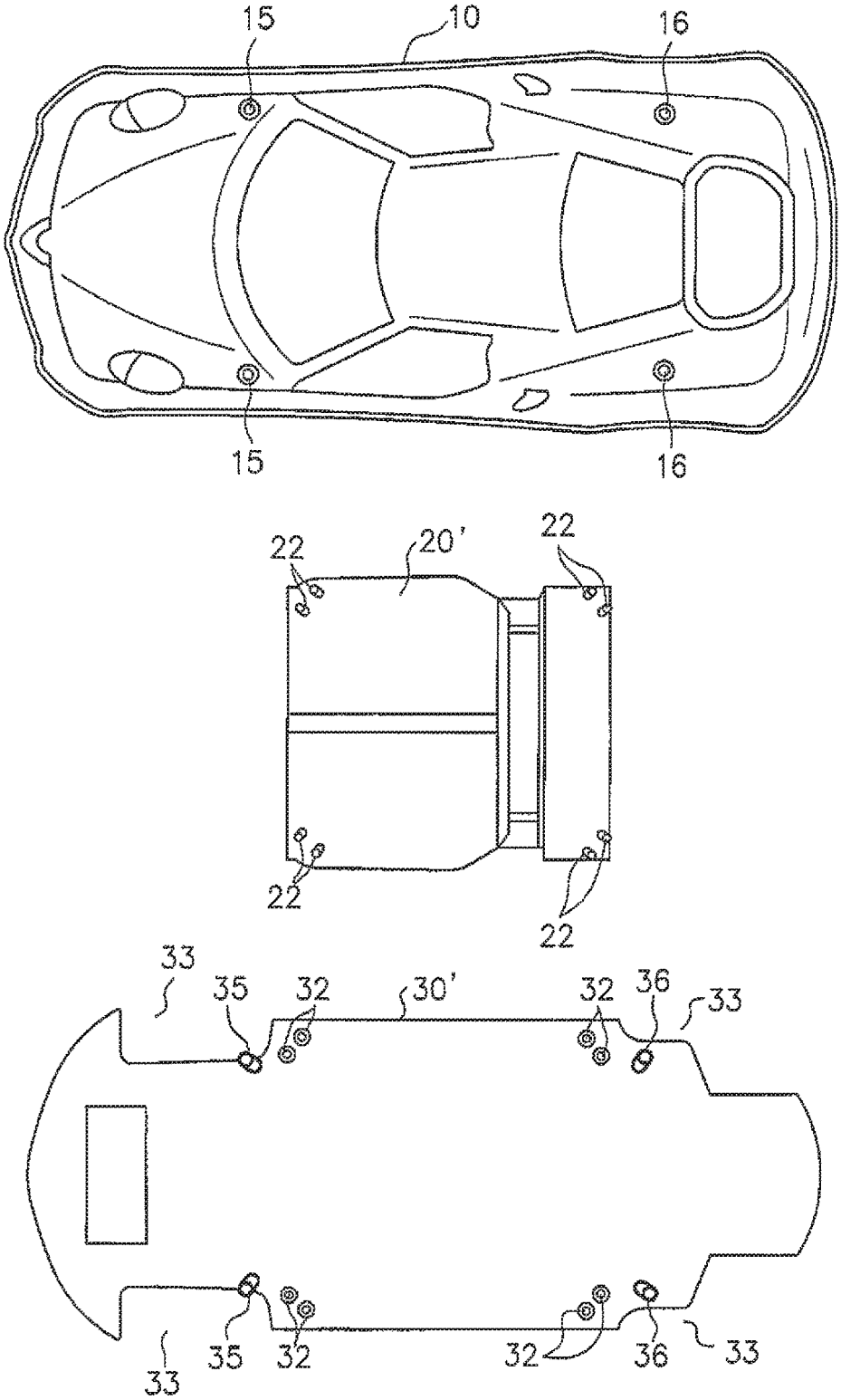
FIG. 4 is a view showing a state in which a body, a reinforcing member and a chassis in a minicar are seen from a back face according to a variant of the present embodiment.

In the example of FIG. 4, the reinforcing member 20' is provided with a plurality of screw fastening holes 22 (stop holes) in positions corresponding to four corners thereof. On the other hand, a chassis 30' has no screw fastening hole 31 shown in FIG. 2 but is provided with a plurality of screw fastening holes 32 (through holes) in positions which are matched with the screw fastening holes 22 included in the reinforcing member 20' respectively. The chassis 30' is fixed to the reinforcing member 20' with a plurality of fixing screws 51 through the screw fastening holes 22 and 32.

Moreover, the chassis 30' has a plurality of screw fastening holes 35 and 36 (all of which are through holes having great heights and cylindrical shapes) provided in positions that, are matched with the screw fastening holes 15 and 16 (stop holes) included in the body 10 respectively. The chassis 30' is fixed to the body 10 with a plurality of fixing screws (having greater lengths than the fixing screw 52 shown in FIG. 1) through the screw fastening holes 15 and 16 and the screw fastening holes 35 and 36.

The method of fixing the body 10, the reinforcing member 20' and the chassis 30' shown in FIG. 4 (the screw fastening positions) is only illustrative and the present invention is not restricted thereto.

Although the description has been given to the example in which the body 10, the reinforcing members 20 and 20' and the chassises 30 and 30' are fixed with the fixing screws in the embodiment, furthermore, the present invention is not restricted thereto. For example, they may be fixed with an adhesive.

Moreover, the shapes of the body 10, the reinforcing members 20 and 20' and the chassises 30 and 30' described in the embodiment are only illustrative and it is apparent that the shapes are varied depending on a vehicle type.

In addition, the embodiment is only illustrative for concreteness to carry out the present invention and the technical scope of the present invention should not be thereby construed to be restrictive. In other words, the present invention can be carried out in various configurations without departing from the gist or main features thereof.

EXPLANATION OF DESIGNATION

10 body
11 cut in which wheel house is accommodated
12 door
13 side sill
20, 20' reinforcing member
21, 22 screw fastening hole
23, 24 wheel house
25, 26 screw fastening hole
27 seat housing portion
28 dashboard installing portion
29 frame portion
30, 30' chassis
31, 32 screw fastening hole
33 cut in which tire is accommodated

The invention claimed is:

1. A car model comprising:

a body formed of a resin;

a reinforcing member which is formed of a metal and is to be fixed to the body; and a chassis to be fixed to the reinforcing member, wherein the body has at least one door which is openably attached thereto with a hinge such that the at least one door can be opened and closed, and a side sill that protrudes below a bottom of the at least one door, the reinforcing member has a frame portion comprising a side surface that is disposed transverse to a planar surface of the chassis when the chassis is fixed to the reinforcing member, and wherein the side sill of the body abuts the side surface of the frame portion when the reinforcing member is fixed to the body such that, with the reinforcing member fixed to the body, the side surface of the frame portion of the reinforcing member inhibits flexing of the side sill when the at least one door is open and closed and, with the reinforcing member fixed to the body, the side surface of the frame portion extends from a first area on a first side of the at least one door to a second area on a second side of the at least one door, the side surface having a recess in an area in which the at least one door opens and closes wherein a width of the side surface in the recess area is reduced as compared with a width of the side surface in the first and second areas.

2. The car model according to claim 1, wherein the reinforcing member further has a plurality of wheel houses and is fixed to the body in positions of the wheel houses.

3. The car model according to claim 2, wherein the car model further comprises left and right front wheels disposed on opposite ends of a front axle and left and right rear wheels disposed on opposite ends of a rear axle and wherein the reinforcing member is configured to extend (a) from a region on a front side of the car model in which the left front wheel is present to a region on a rear side of the car model in which the left rear wheel is present, (b) from a region on the front side of the car model in which the right front wheel is present to a region on the rear side of the car model in which the right rear wheel is present, (c) from the region on the front side of the car model in which the left front wheel is present to the region on the front side of the car model in which a the right front wheel is present, and (d) from the region on the rear side of the car model where the left rear wheel is present to the region on the rear side of the car model where the right rear wheel is present.

4. The car model according to claim 1, wherein the reinforcing member has a plurality of wheel houses and is fixed to the body in positions of the wheel houses, and wherein the model further comprises a plurality of wheels disposed on opposite ends of an axle, and wherein, when the model is assembled with the chassis fixed to the reinforcing member, the axle is disposed above the planar surface of the chassis with respective first portions of the plurality of wheels accommodated in the plurality of wheel houses and with respective second portions of the plurality of wheels protruding through respective notches in the chassis.

5. The car model according to claim 4, wherein the car model further comprises left and right front wheels disposed on opposite ends of a front axle and left and right rear wheels disposed on opposite ends of a rear axle and wherein the reinforcing member is configured to extend (a) from a region on a front side of the car model in which the left front wheel is present to a region on a rear side of the car model in which the left rear wheel is present, (b) from a region on the front side of the car model in which the right front wheel is present to a region on the rear side of the car model in which the right rear wheel is present, (c) from the region on the front side of the car model in which the left front wheel is present to the region on the front side of the car model in which the right front wheel is present, and (d) from the region on the rear side of the car model where the left rear wheel is present to the region on the rear side of the car model where the right rear wheel is present.

6. The car model according to claim 4, wherein each of the plurality of wheel houses of the reinforcing member has the shape of a curve, and wherein the car model comprises means for fastening each of the plurality of wheelhouses to the body at apices of the respective curves of the wheel houses.

7. The car model according to claim 6, wherein the means for fastening consists of a plurality of fastening holes disposed at the apices of the respective curves.

8. The car model according to claim 1, wherein the car model further comprises left and right front wheels disposed on opposite ends of a front axle and left and right rear wheels disposed on opposite ends of a rear axle and wherein the reinforcing member is configured to extend (a) from a region on a front side of the car model in which the left front wheel is present to a region on a rear side of the car model in which the left rear wheel is present, (b) from a region on the front side of the car model in which the right front wheel is present to a region on the rear side of the car model in which the right rear wheel is present, (c) from the region on the front side of the car model in which the left front wheel is present to the region on the front side of the car model in which the right front wheel is present, and (d) from the region on the rear side of the car model where the left rear wheel is present to the region on the rear side of the car model where the right rear wheel is present.

9. The car model according to claim 1, wherein the body is a unitary structure.

10. The car model according to claim 9, wherein the body is molded from the resin.

11. The car model according to claim 9, wherein, with the body fixed to the frame, the body sits atop the frame.

* * * * *